United States Patent [19]

Avdenko et al.

[11] Patent Number: 5,070,845

[45] Date of Patent: Dec. 10, 1991

[54] FUEL INJECTION NOZZLE

[75] Inventors: Anatol Avdenko, Rochester; Richard L. Cooper, Leroy; Gary J. DeAngelis, Spencerport; Kurt T. Hertzog, Henrietta; Grover W. Preston, Rochester; Edwin A. Rivera, Fairport; Jeffrey A. Rock, Rochester; Roland S. Taylor, Fairport; Robert A. Zaso, Rochester, all of N.Y.

[73] Assignee: General Motors Corporation, Detroit, Mich.

[21] Appl. No.: 355,224

[22] Filed: May 22, 1989

[51] Int. Cl.[5] ..... F02M 55/02

[52] U.S. Cl. ..... 123/470; 123/472; 239/204; 239/533.3; 137/537

[58] Field of Search ..... 123/472, 470, 468, 469, 123/456; 137/537; 239/304, 533.1-533.12

[56] References Cited

U.S. PATENT DOCUMENTS

| | | | |
|---|---|---|---|
| 575,451 | 1/1897 | Yost . | |
| 1,428,553 | 9/1922 | Oates | 239/204 |
| 1,985,192 | 12/1934 | O'Marra | 137/537 |
| 2,756,106 | 7/1956 | Schenk . | |
| 2,832,641 | 4/1958 | Korda | 137/537 |
| 3,008,653 | 11/1961 | Morris | 239/453 |
| 3,077,206 | 2/1963 | Graham | 137/537 |
| 3,542,293 | 11/1970 | Bishop . | |
| 3,705,692 | 12/1972 | Garnier . | |
| 4,590,911 | 5/1986 | Sciotti . | |
| 4,718,386 | 1/1988 | Gieles | 123/472 |
| 4,768,720 | 9/1988 | Cocca . | |

FOREIGN PATENT DOCUMENTS

| | | |
|---|---|---|
| 3631223A1 | 3/1988 | Fed. Rep. of Germany . |
| 3722304A1 | 1/1989 | Fed. Rep. of Germany . |
| 886258 | 1/1962 | United Kingdom . |

*Primary Examiner*—Carl Stuart Miller

*Attorney, Agent, or Firm*—C. K. Veenstra

[57] ABSTRACT

A fuel injection nozzle has a tubular body adapted to receive fuel, a tubular seat member mounted to the body, the seat member having an opening for discharging fuel and a valve seat surrounding the opening, a poppet valve member engageable with the valve seat to interrupt fuel flow through the opening, and an extension spring anchored to the body and to the valve member and biasing the valve member to engage the valve seat. The extension spring is a helically coiled spring with each coil lying close to the adjacent coils and with the coils at one end overlying an end of the body to anchor the spring to the body and to cause fuel flowing through the nozzle to pass between the coils of the spring; the spring thereby acts as a filter for fuel to be discharged by the nozzle. The seat member is axially movable relative to the body to adjust the length of the spring and thus the bias on the valve member whereby the desired valve-opening pressure differential may be established. The body is adapted to receive fuel through a restriction member that limits fuel flow through the opening. The valve member has a shank with a valve element at one end and a head at the other end, the shank being formed as a pin and the valve element as a ball that is welded to the pin.

3 Claims, 2 Drawing Sheets

FUEL INJECTION NOZZLE

TECHNICAL FIELD

This invention relates to a nozzle for discharging fuel to an internal combustion engine.

BACKGROUND

In the fuel injection system set forth in U.S. patent application Ser. No. 010296 filed Feb. 2, 1987 in the names of E. R. Stettner and D. D. Stoltman, a single injector meters fuel which is distributed through fuel lines to a plurality of nozzles, and the nozzles discharge the fuel adjacent the engine intake ports. The nozzles shown in that document do not maintain pressure in the fuel distribution lines.

In the fuel injection system set forth in U.S. Pat. No. 4590911 issued May 27, 1986 in the names of R. Sciotti and D. E. Mocko, a plurality of valves permit and terminate fuel flow, and each injector has a nozzle to discharge the fuel adjacent an engine intake port. The nozzle shown in that document is provided with a poppet valve that appears to maintain pressure between the valve and the nozzle.

The fuel injector shown in U.S. Pat. No. 3705692 issued Dec. 12, 1972 in the name of G. Garnier has an integral nozzle to discharge the fuel. The nozzle shown in that document is provided with a poppet valve that appears to maintain pressure in the injector below the metering valve.

The nozzles shown in U.S. Pat. No. 2756106 issued July 24, 1956 in the name of R. Schenk, and in U.S. Pat. No. 3542293 issued Nov. 24, 1970 in the names of I. N. Bishop, M. A. Choma and L. Hideg, are provided with poppet valves that appear to maintain pressure in the fuel line.

SUMMARY OF THE INVENTION

This invention provides an improved nozzle suitable for use in a fuel injection system in which a single injector meters fuel which is distributed through fuel lines to a plurality of nozzles, and in which the nozzle has a poppet valve that maintains pressure in the fuel distribution lines.

In a fuel injection nozzle according to this invention, a tubular body is adapted to receive fuel, a tubular seat member is mounted to the body, the seat member has an opening for discharging fuel and a valve seat surrounding the opening, a poppet valve member is engageable with the valve seat to interrupt fuel flow through the opening, and an extension spring is anchored to the body and to the valve member and biases the valve member to engage the valve seat.

The improved fuel injection nozzle provided by this invention may include, as one feature, a helically coiled extension spring with the coils at one end overlying an end of the body to anchor the spring to the body.

The improved fuel injection nozzle provided by this invention may include, as another feature, a helically coiled extension spring in which each coil lies close to the adjacent coils and with the coils at one end overlying the inlet end of the body so the fuel flows between the coils of the spring. The spring thereby acts as a fuel filter.

The improved fuel injection nozzle provided by this invention may include, as a further feature, a seat member that is axially movable relative to the body to adjust the length of the spring and thus the bias on the valve member, whereby the desired valve-opening pressure differential may be established.

The improved fuel injection nozzle provided by this invention may include, as yet another feature, a body that is adapted to receive fuel through a restriction member. The restriction member limits fuel flow through the opening to provide a means of calibrating the fuel flow through the nozzle.

The improved fuel injection nozzle provided by this invention may include, as an additional feature, a valve member that has a shank with a valve at one end and a head at the other end, the shank being formed as a pin and the valve as a ball that is welded to the pin.

The improved fuel injection nozzle provided by this invention also may include a helically coiled extension spring with the coils at one end of the spring surrounding the head of the valve member to anchor the spring to the valve member.

The improved fuel injection nozzle provided by this invention may further include a body adapted to receive fuel through a plastic fuel line having one end secured about the body and having an integral flange ultra-sonically formed on the other end. The ultra-sonically-formed flange facilitates assembly of the fuel line to a source of fuel.

Moreover, the improved fuel injection nozzle provided by this invention may include a peripheral locating flange and may be received in a mounting bushing that has an annular groove receiving and retaining the locating flange and a plurality of peripheral beads adapted to seal and secure the nozzle in an engine.

The details as well as other features and advantages of a preferred embodiment of a fuel injection nozzle employing the features provided by this invention are set forth in the remainder of the specification and are shown in the accompanying drawings.

THE PREFERRED EMBODIMENT

Figure 1:
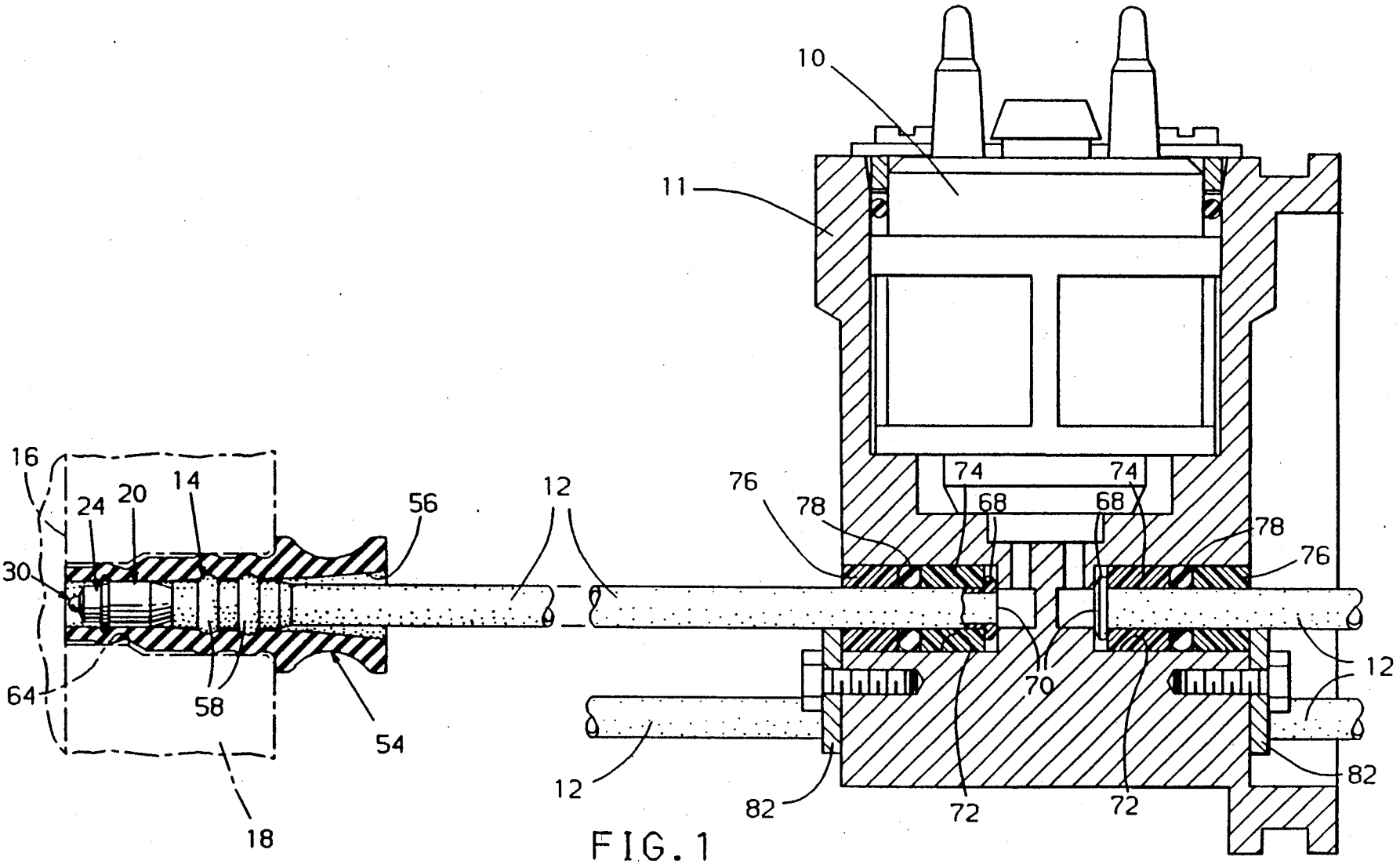
FIG. 1 shows a fuel injection system having a single injector that meters fuel which is distributed through fuel lines to a plurality of nozzles employing the features provided by this invention.
Figure 2:
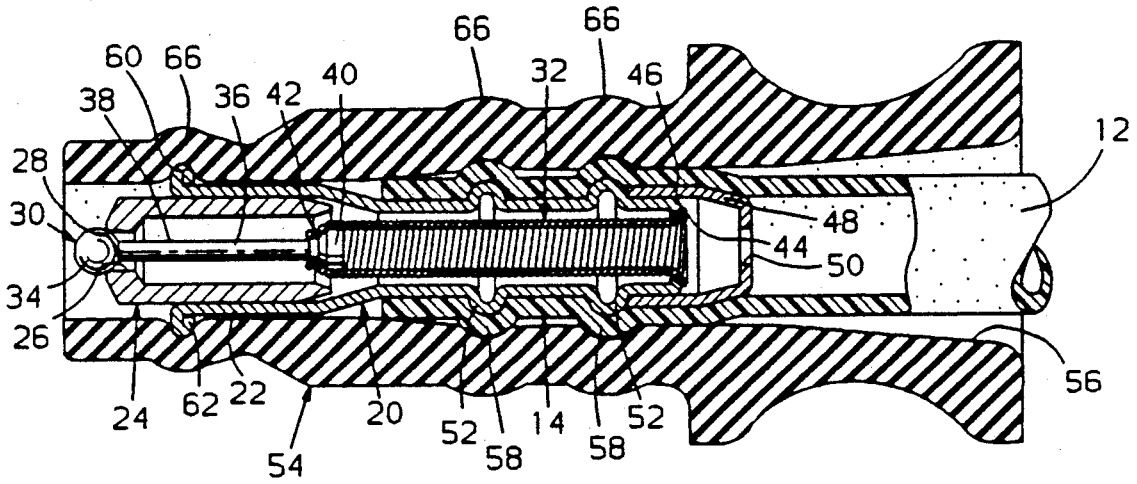
FIG. 2 is an enlarged view of a portion of the FIG. 1 nozzle removed from the engine and the fuel meter body, showing its details of construction.

Referring to the drawings, a single injector 10 is mounted in a fuel meter body 11 that provides fuel at a desired pressure; injector 10 meters fuel into a plurality of fuel distribution lines 12. Each line 12 forms part of a nozzle 14 that discharges the metered fuel into the stream of air flowing through an inlet port 16 to a combustion chamber of an internal combustion engine 18.

Nozzle 14 has a tubular body 20 adapted to receive fuel from its fuel distribution line 12. The left end 22 of body 20 is bell-shaped to receive a tubular seat member 24. Seat member 24 has an opening 26 for discharging fuel and a valve seat 28 surrounding opening 26. A poppet valve member 30 is engageable with valve seat 28 to interrupt fuel flow through opening 26, and a helically coiled extension spring 32 is anchored to body 20 and to valve member 30 and biases valve member 30 to engage valve seat 28. When the pressure differential across valve member 30 reaches a desired level, the valve member is displaced from valve seat 28 and nozzle 14 discharges fuel to engine inlet port 16.

Valve member 30 comprises a ball 34 forming a valve element that is welded to the shank 36 of a pin 38. The head 40 of pin 38 is surrounded by a section 42 of reduced coils at the left end of extension spring 32 to anchor spring 32 to valve member 30.

The right end 44 of extension spring 32 has enlarged coils that overlie the inwardly turned end 46 of body 20 to anchor spring 32 to body 20.

Each coil of extension spring 32 is close to the adjacent coils, and the enlarged coils at the right end 44 of spring 32 cause the fuel flowing through nozzle 14 to pass between the coils of spring 32. Spring 32 thereby acts as a fuel filter.

A restriction member 48 is received over the right end 46 of body 20 and has a calibrated orifice 50 that limits fuel flow through nozzle 14. The orifice 50 in each nozzle assures that fuel is distributed equally to all nozzles.

Seat member 24 is axially movable relative to body 20 to adjust the length of spring 32 and thus the bias exerted by spring 32 on valve member 30. This adjustment allows factory calibration of the pressure differential across valve member 30 at which the valve member is displaced from valve seat 28.

Fuel distribution line 12 is slipped over body 20 and expands to fit over a pair of peripheral beads 52 formed on body 20. Nozzle 14 also has a molded rubber mounting bushing 54 with a central bore 56 that embraces the expanded portions 58 of fuel line 12. Within bore 56, an annular groove 60 receives a peripheral locating flange 62 formed on body 20 to retain body 20 within bushing 54.

Bushing 54 is mounted in an aperture 64 in the wall of inlet port 16 and has a series of peripheral beads 66 that engage the wall to retain and seal bushing 54 within aperture 64.

Fuel distribution line 12 is formed of nylon and has an integral flange 68 ultra-sonically formed at its end 70 remote from body 20. The end 70 of line 12 is received in a distribution outlet 72 opening from fuel meter body 11, and is surrounded and supported in outlet 72 by a pair of backup rings 74 and 76 that sandwich an O-ring 78.

Nozzle 14 is assembled by inserting seat member 24 in body 20, inserting the shank 36 of pin 38 through the reduced coils 42 of spring 32 to secure the head of pin 38 to spring 32 and inserting spring 32 in body 20 to secure the enlarged coils 44 over the end 46 of body 20, inserting a mandrel through spring 32 to engage the head 40 of pin 38 and advance the shank 36 of pin 38 through opening 26, welding ball 34 to the shank 36 of pin 38, removing the mandrel to allow spring 32 to engage ball 34 with valve seat 28, fitting restriction member 48 over the end 46 of body 20, sliding backup ring 74, 0-ring 78 and backup ring 76 on fuel line 12 and slipping fuel line 12 over beads 52 on body 20, and inserting body 20 into bushing 54 until flange 62 is received in groove 60.

Nozzle 14 is connected to fuel meter body 11 by inserting the end 70 of fuel distribution line 12, with backup rings 74 and 76 and 0-ring 78, into outlet 72 and securing a retainer 82 over the edge of outlet 72 to engage backup ring 76.

It will be appreciated that fuel distribution line 12 is flexible and bends to allow bushing 54 to mount nozzle 14 at the correct angle; fuel line 12 is shown here as a straight tube only for convenience.

The position of seat member 24 within body 20 is adjusted so valve member 30 is displaced from valve seat 28 when the pressure in body 20 rises to a desired differential above the pressure in inlet port 16. Thus when injector 10 meters fuel into distribution line 12, valve member 30 opens to discharge fuel into inlet port 16, and the pressure drop across orifice 50 assures that the fuel metered by injector 10 is divided equally among all the nozzles. When injector 10 interrupts fuel flow to distribution line 12, spring 32 engages valve member 30 against its seat 28 and the residual pressure then suppresses formation of fuel vapor in nozzle 14 and fuel meter body 11.

We claim:

1. A fuel injection nozzle comprising a tubular body adapted to receive fuel from a plastic fuel line, a tubular seat member mounted to a first end of said tubular body, said seat member having an opening for discharging fuel and a valve seat surrounding said opening, a poppet valve member engageable with said valve seat to interrupt fuel flow through said opening, and an extension spring anchored to said body and to said valve member and biasing said valve member to engage said valve seat, said valve member being displaced from said valve seat against the bias of said spring to permit fuel flow through said opening in response to a desired pressure differential across said valve member, said tubular body, having a locating flange located at said first end and a peripheral bead formed intermediate of said first end and the second end, received in a mounting bushing having a central bore with a first annular groove for receiving and retaining said locating flange and a second annular groove configured to receive and retain said plastic fuel line between said peripheral bead and said second groove, said mounting bushing further having a plurality of peripheral beads adapted to seal and secure the nozzle in an engine.

2. A fuel injection nozzle comprising a tubular body adapted to receive fuel, a tubular seat member mounted to one end of said body, said seat member having an opening for discharging fuel and a valve seat surrounding said opening, a poppet valve member engageable with said valve seat to interrupt fuel flow through said opening, and an extension spring anchored to said body and to said valve member and biasing said valve member to engage said valve seat, said valve member being displaced from said valve seat against the bias of said spring to permit fuel flow through said opening in response to a desired pressure differential across said valve member, wherein said extension spring is a helically coiled spring with the coils at one ned overlying an end of said body to anchor said spring to said body, wherein each coil of said spring lies close to the adjacent coils and the coils at one end overlie an end of said body whereby fuel flow through said nozzle must pass between the coils of said spring and said spring thereby acts as a filter for fuel to be discharged by said nozzle, wherein said seat member is axially movable relative to said body to adjust the length of said spring and thus the bias on said valve member whereby said desired pressure differential may be established, a restriction member mounted to a second end of said tubular body having a calibrated orifice that limits fuel flow through said opening, wherein said valve member has a shank portion with a valve portion at one end and a head portion at the other end, said valve portion being adapted to engage said valve seat, said shank portion being formed as a pin and said valve portion as a ball that is welded to said pin, and wherein the coils at the other end of said spring surround said head portion to anchor said spring to said valve member.

3. A fuel injection nozzle comprising a tubular body adapted to receive fuel, a tubular seat member mounted to one end of said body, said seat member having an opening for discharging fuel and a vale seat surrounding said opening, a poppet valve member engageable with said valve seat to interrupt fuel flow through said opening, and an extension spring anchored to said body and to said valve member and biasing said valve member to engage said valve seat, said valve member being displaced from said valve seat against the bias of said spring to permit fuel flow through said opening in response to a desired pressure differential across said valve member, wherein said extension spring is a helically coiled spring with the coils at one end overlying an end of said body to anchor said spring to said body, wherein each coil of said spring lies close to the adjacent coils and the coils at one end overlie an end of said body whereby fuel flow through said nozzle must pass between the coils of said spring and said spring thereby acts as a filter for fuel to be discharged by said nozzle, wherein said seat member is axially movable relative to said body to adjust the length of said spring and thus the bias on said valve member whereby said desired pressure differential may be established, a restriction member mounted to a second end of said tubular body having a calibrated orifice that limits fuel flow through said opening, wherein said valve member has a shank portion with a valve portion at one end and a head portion at the other end, said valve portion being adapted to engage said valve seat, said shank portion being formed as a pin and said valve portion as a ball that is welded to said pin, wherein the coils at the other end of said spring surround said head portion to anchor said spring to said valve member, wherein said body is adapted to receive fuel through a plastic fuel line having one end secured about said body, the other end of said fuel line having an integral flange ultra-sonically formed thereon to facilitate assembly to a source of fuel, and wherein said tubular body has a peripheral locating flange at said first end and a peripheral bead formed intermediate of said first end and the second end, received in a mounting bushing, having a central bore with a first annular groove for receiving and retaining said locating flange and a second annular groove configured to receive and retain said plastic fuel line between said peripheral bead and said second groove, said mounting bushing further having a plurality of peripheral beads adapted to sealingly secure said bushing in an engine.

* * * * *